US010993509B2

(12) United States Patent
Ikeguchi et al.

(10) Patent No.: US 10,993,509 B2
(45) Date of Patent: May 4, 2021

(54) FASTENER STRINGER AND SLIDE FASTENER

(71) Applicant: YKK CORPORATION, Tokyo (JP)

(72) Inventors: Yoshito Ikeguchi, Toyama (JP); Masaki Meiwa, Toyama (JP); Yukako Nakamura, Toyama (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 16/709,583

(22) Filed: Dec. 10, 2019

(65) Prior Publication Data

US 2020/0187603 A1 Jun. 18, 2020

(30) Foreign Application Priority Data

Dec. 12, 2018 (JP) ..... JP2018-232865

(51) Int. Cl.
*A44B 19/34* (2006.01)

(52) U.S. Cl.
CPC ..... *A44B 19/343* (2013.01)

(58) Field of Classification Search
CPC ..... Y10T 24/2521; D10B 2501/0631; A44B 19/343; A44B 19/12; A44B 19/08; A44B 19/04
See application file for complete search history.

(56) References Cited

U.S. PATENT DOCUMENTS 3,922,760 A * 12/1975 Matsuda ..... A44B 19/406 24/393
3,974,550 A * 8/1976 Fujisaki ..... A44B 19/343 24/393
6,082,148 A 7/2000 Wakai et al.
7,152,438 B2 * 12/2006 Matsuda ..... A44B 19/343 66/192
7,293,434 B2 * 11/2007 Ikeguchi ..... A44B 19/40 66/193

FOREIGN PATENT DOCUMENTS

JP 2001-211913 A 8/2001
WO 2011/007411 A1 1/2011
WO 2011007411 A1 1/2011

OTHER PUBLICATIONS

Extended European Search Report for related EP App No. 19214678.5 dated May 12, 2020, 7 pgs.

* cited by examiner

*Primary Examiner* — Robert Sandy
(74) *Attorney, Agent, or Firm* — Procopio, Cory, Hargreaves & Savitch LLP

(57) ABSTRACT

Fastener stringer may include a knitted fastener tape, and a fastener element attached to the fastener tape. The fastener tape may include a first side-edge portion where the fastener element is provided, a second side-edge portion provided at an opposite side of the first side-edge portion, and a tape main portion provided between the first and second side-edge portions. The first side-edge portion may include one or more chain-stitch yarns formed in one or more wales. The second side-edge portion may not include a chain-stitch yarn. The tape main portion may include M or more chain-stitch yarns formed in M or more wales. M may indicate a natural number equal to or greater than one third of the total number of wales included in the fastener tape. Difference in yarn density may be caused between the tape main portion and the second side-edge portion.

13 Claims, 11 Drawing Sheets

[Fig. 1]
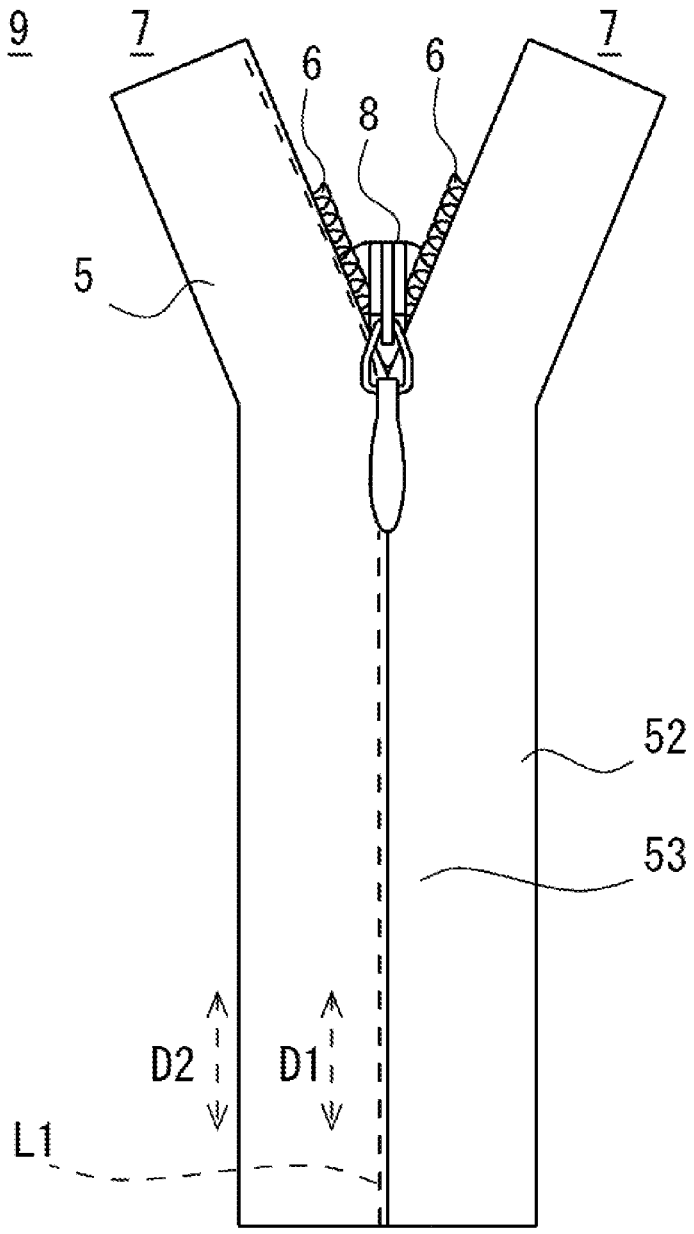

[Fig. 2]
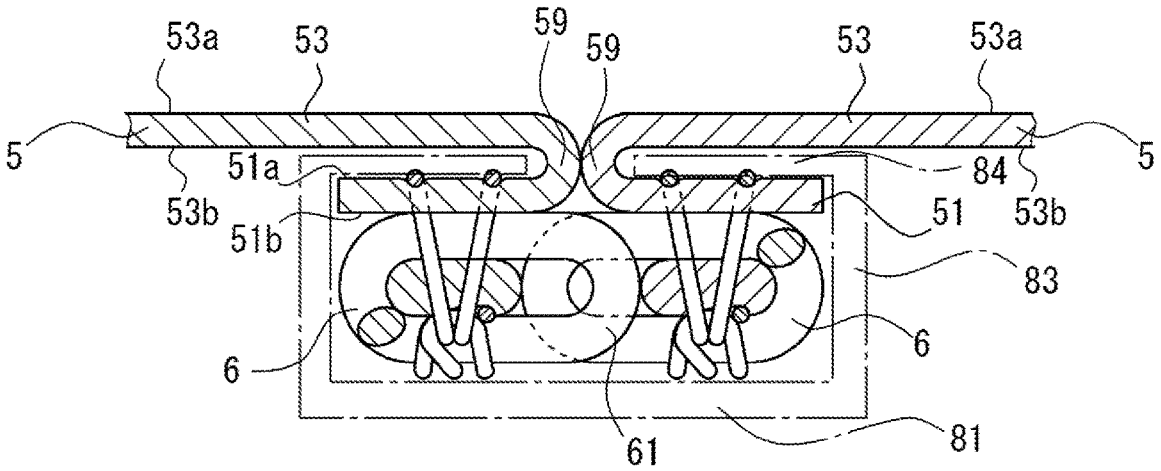

[Fig. 3]
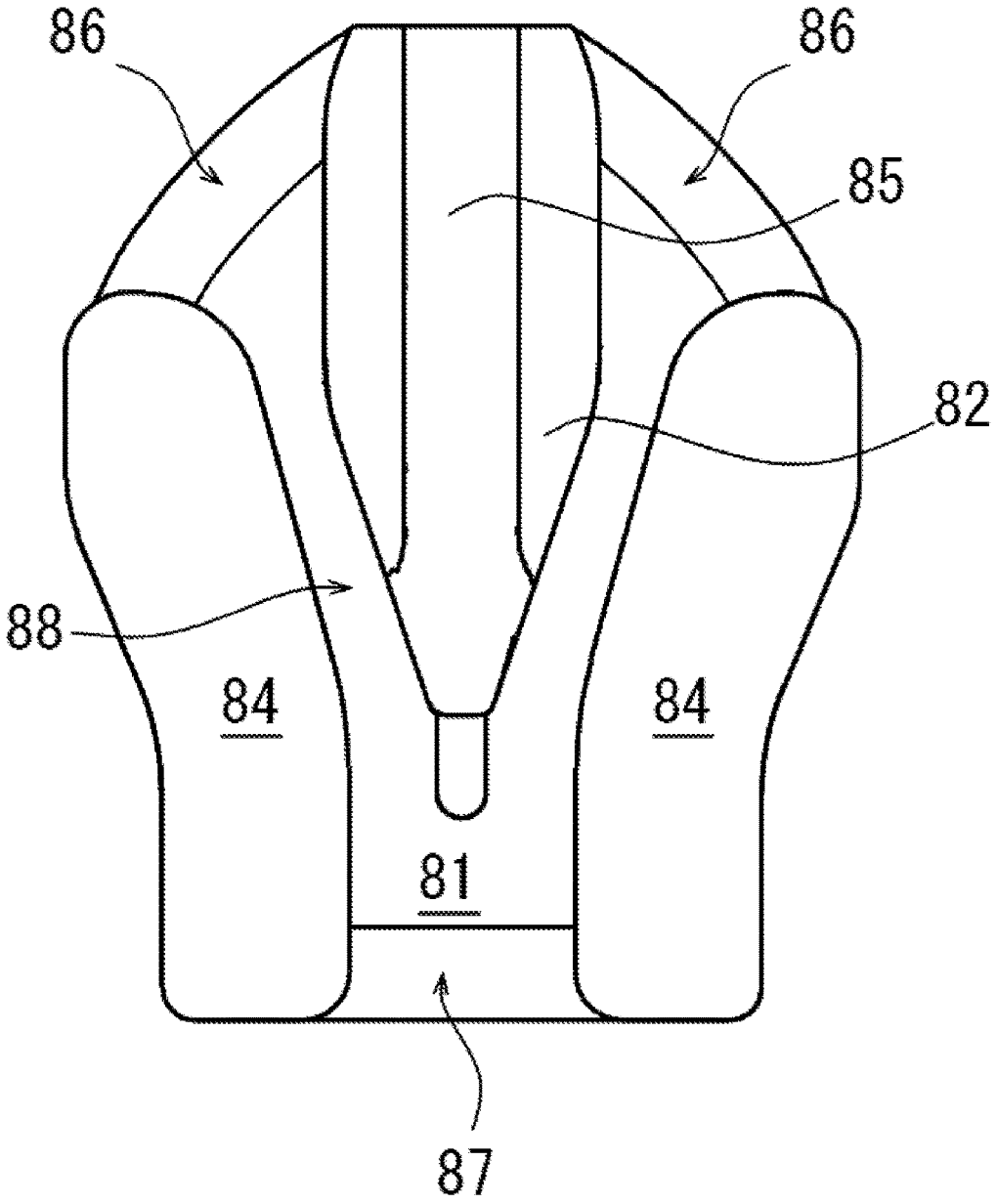

[Fig. 4]
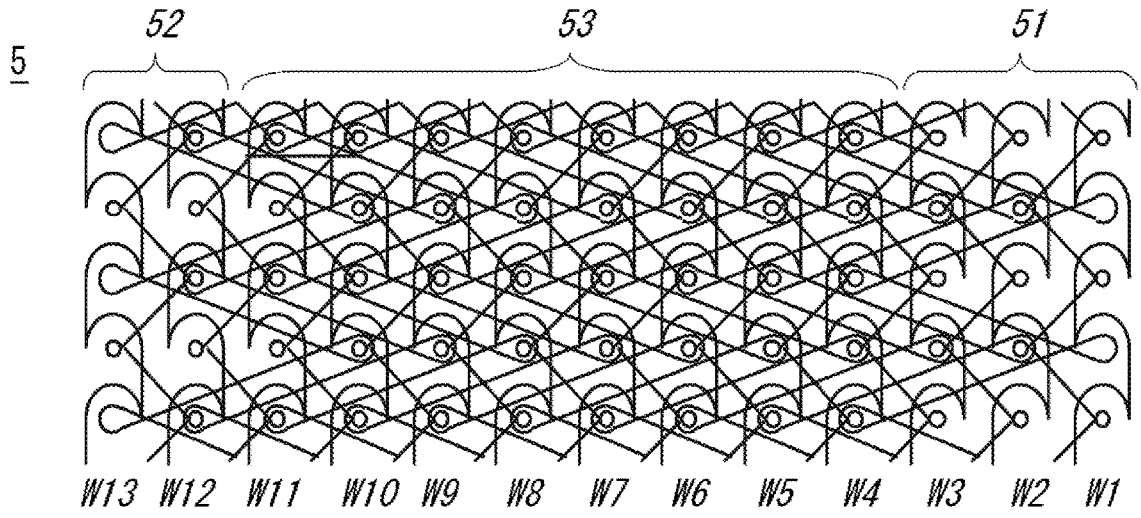
[Fig. 5]
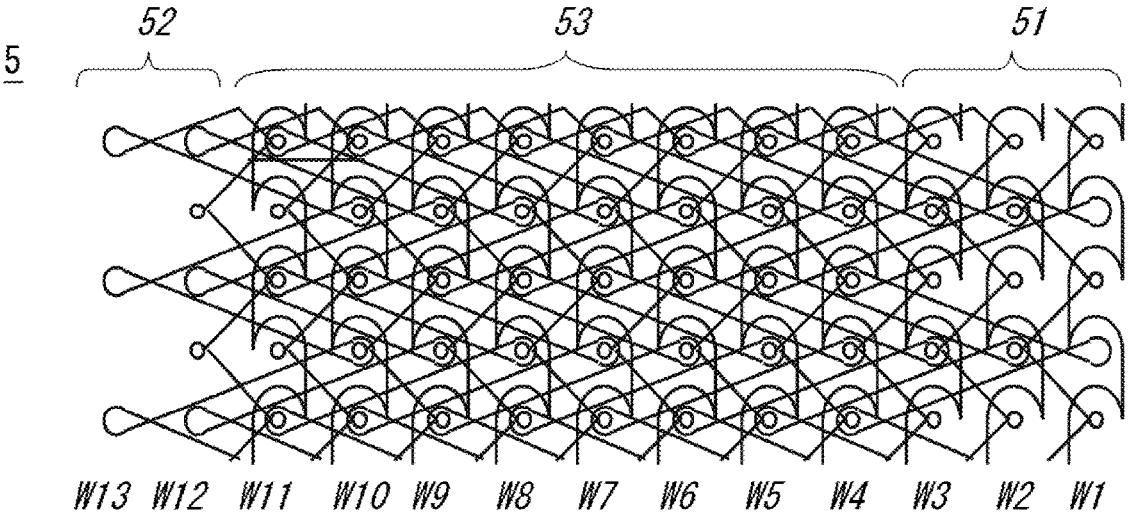

[Fig. 6]
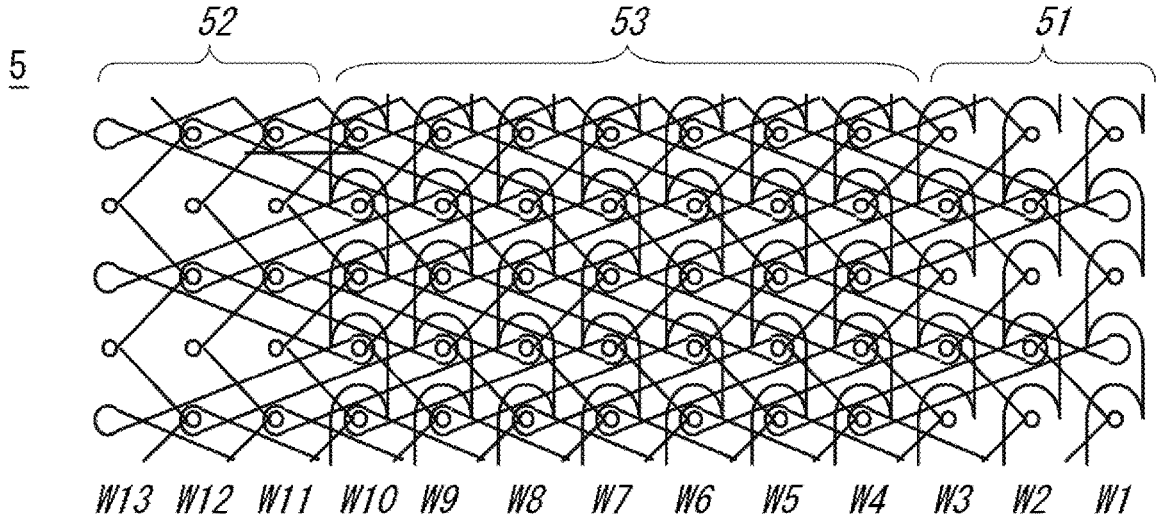

[Fig. 7]
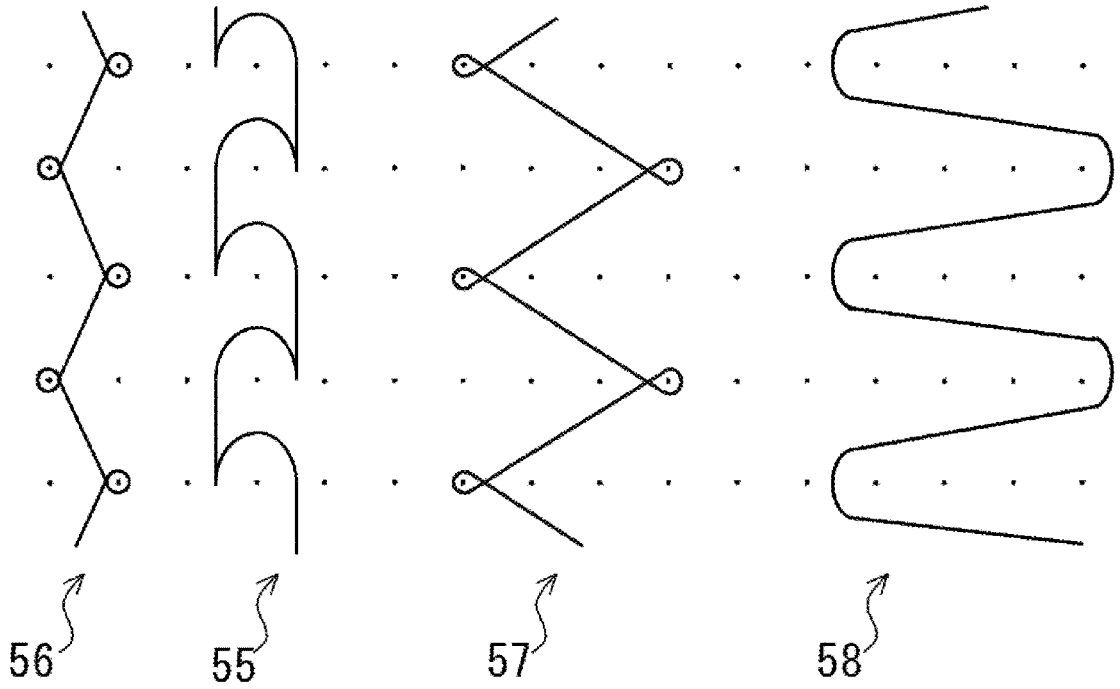

[Fig. 8]
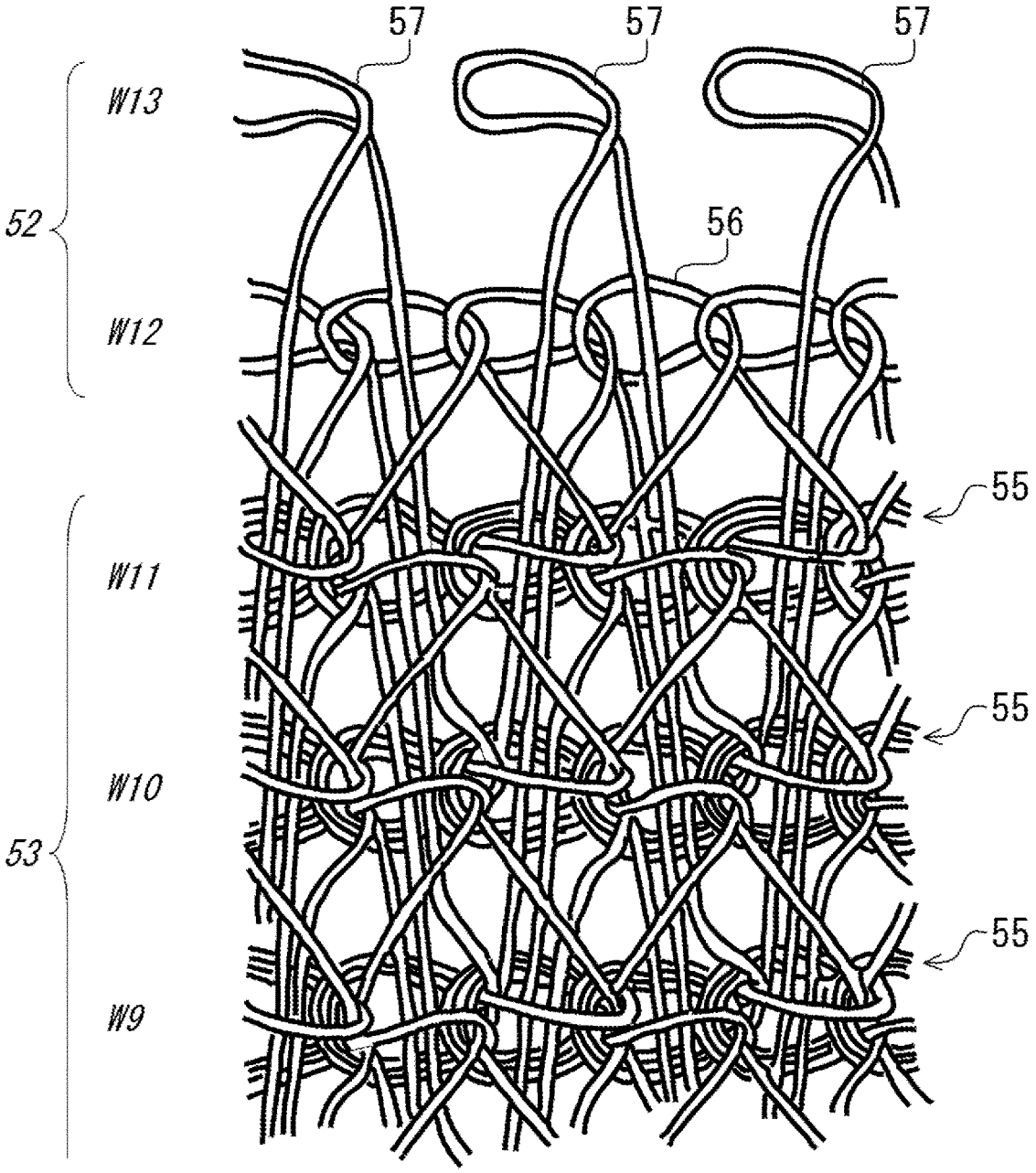

[Fig. 9]
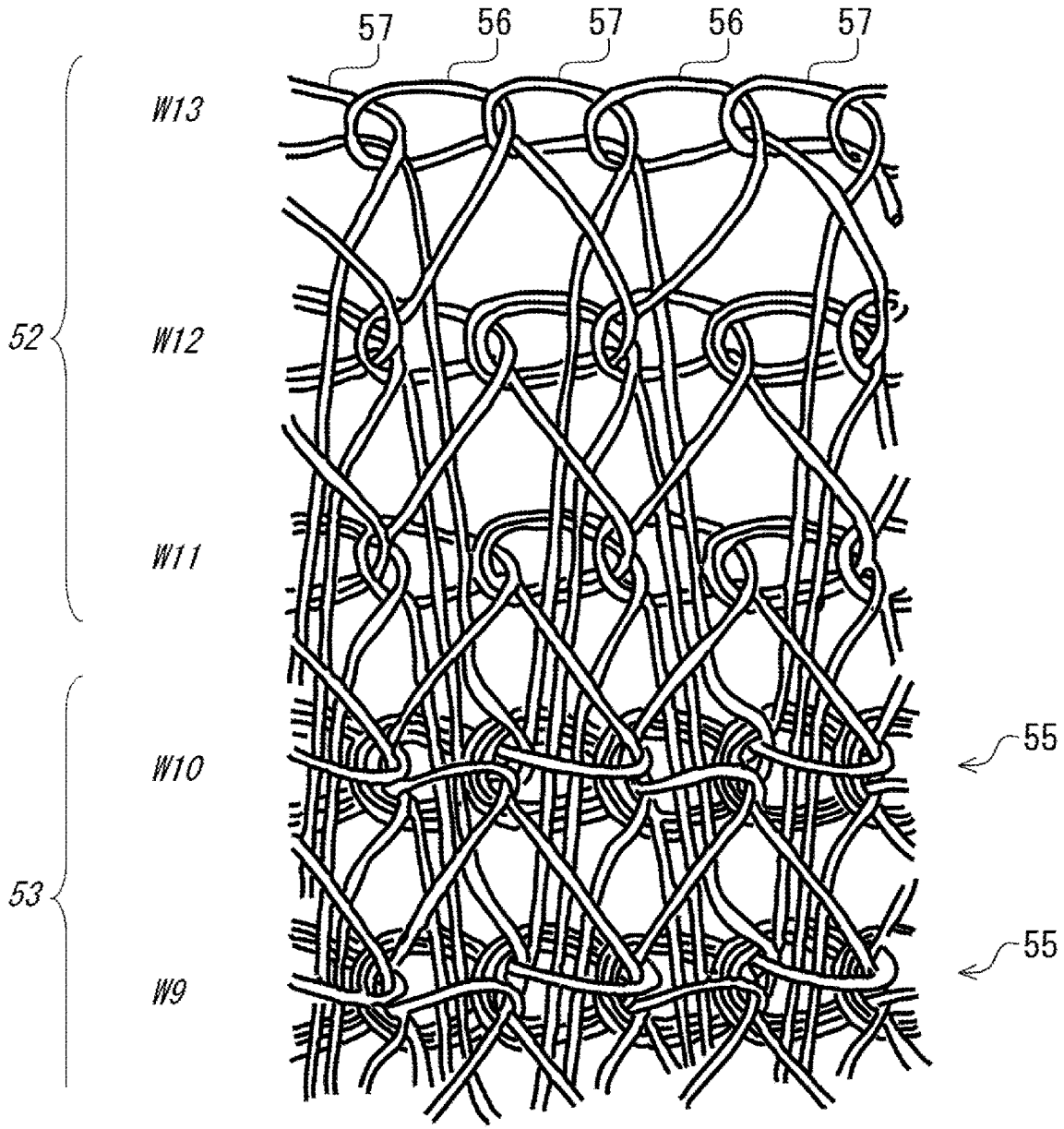

[Fig. 10]
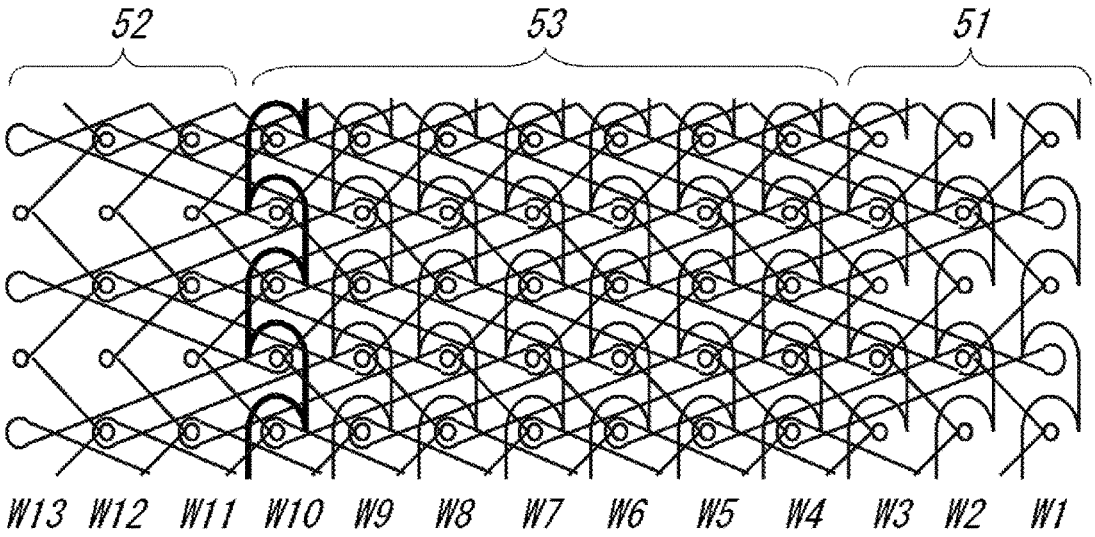
[Fig. 11]
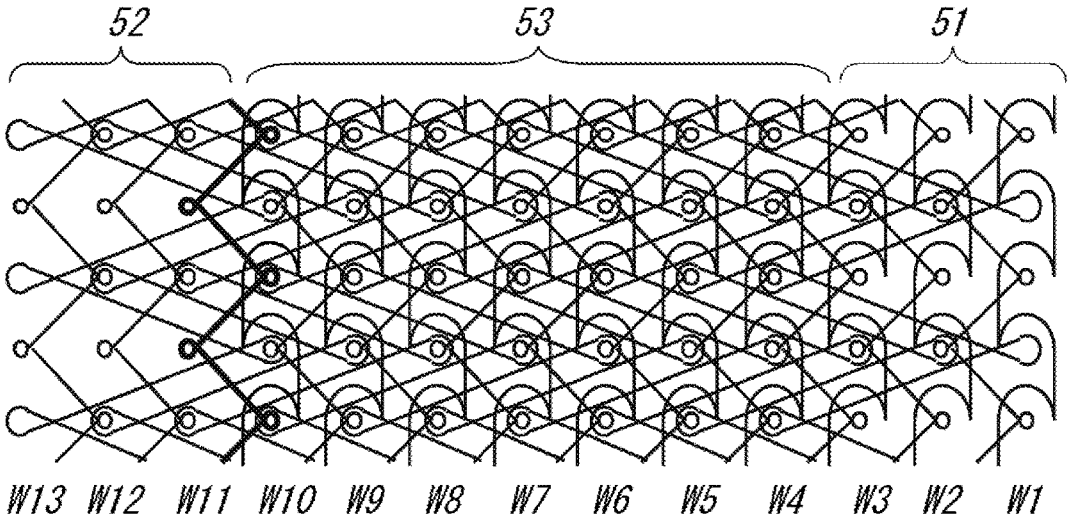

[Fig. 12]
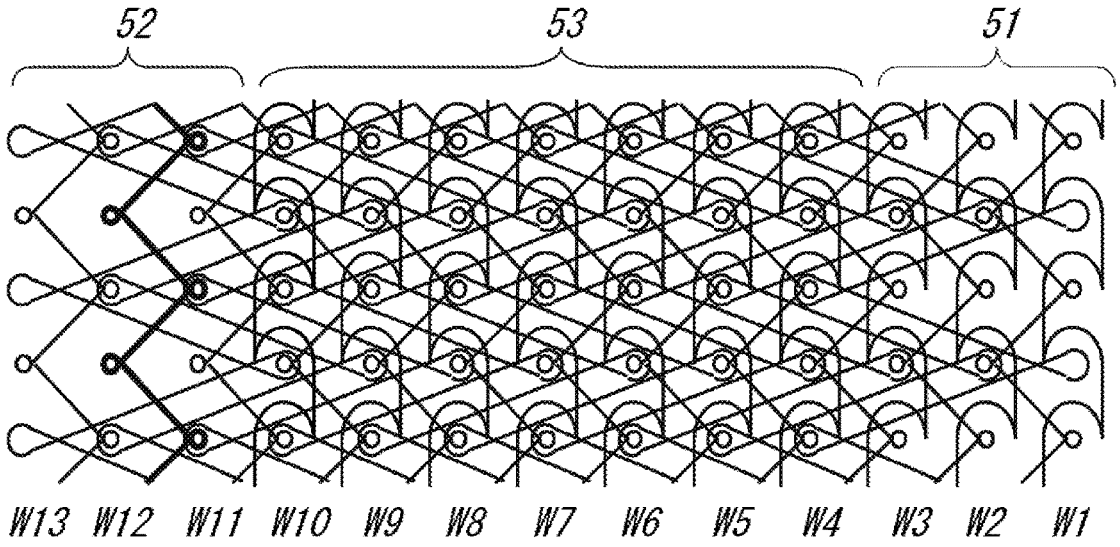
[Fig. 13]
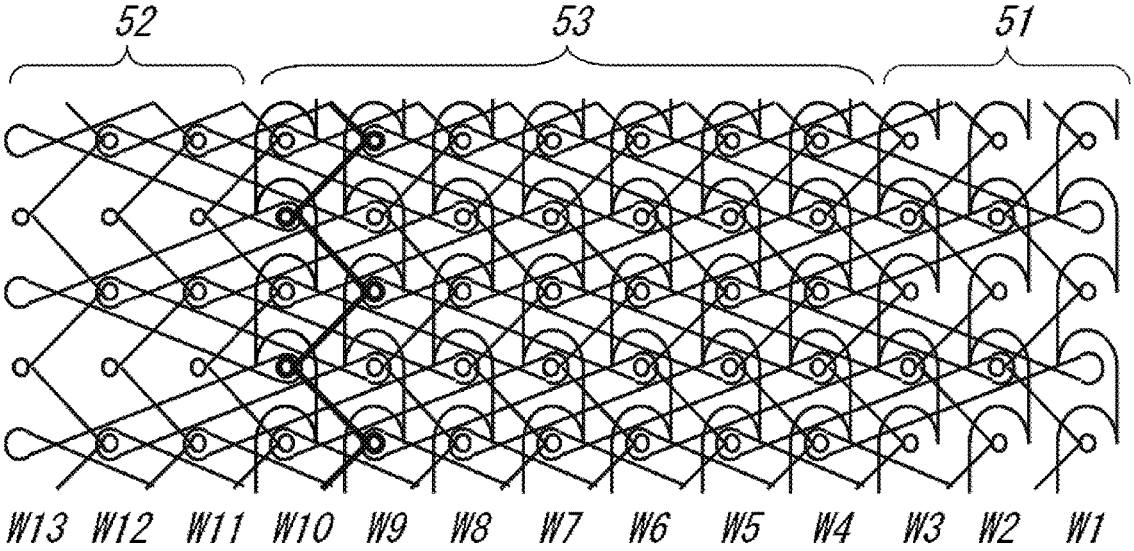

[Fig. 14]
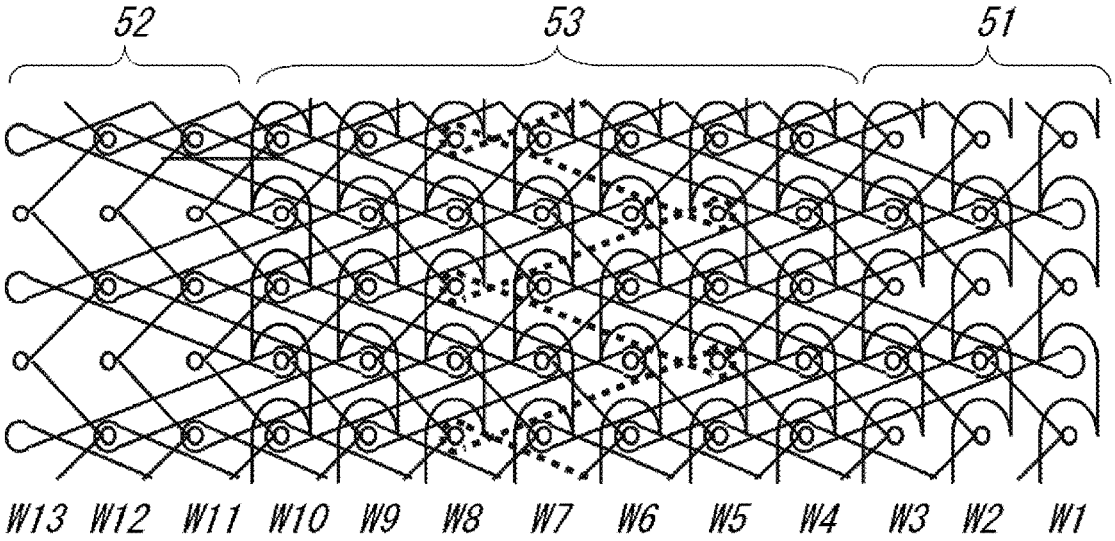

FASTENER STRINGER AND SLIDE FASTENER

CROSS-REFERENCE TO RELATED APPLICATION

The present application claims a priority of Japanese Patent Application No. 2018-232865, filed on Dec. 12, 2018 and entitled "Fastener stringer and slide fastener", the entire content of which is hereby incorporated by reference.

TECHNICAL FIELD

The present disclosure is related to fastener stringers and slide fasteners.

BACKGROUND

International Publication No. 2011/007411 discloses, as would be understood by comparison of FIGS. 3 and 6, a chain-stitch yarn at wale W13 is dissolved, thus enhancing stretch properties or softness of a fastener tape. Further, this document discloses that reinforcing chain-stitch yarns are provided at $4^{th}$ to $6^{th}$ wales W4-W6 of a tape main portion 11*a*, thus enhancing durability against a physical contact by a flange of a slider (See para. 0064).

Japanese Patent Application Laid-open No. 2001-211913 discloses that identification yarns are knitted into a tape fabric so that slide fasteners can be distinguishable.

SUMMARY

There is a need to distinguish fastener tapes with enhanced stretch properties or softness from fastener tapes without enhanced stretch properties or softness. If a chain-stitch structure is knitted into a tape main portion of a faster tape with enhanced stretch properties or softness, the stretch properties or softness of the fastener tape may be lowered. Therefore, it is uncommon to knit a chain-stitch structure into a fastener tape designed to have enhanced stretch properties or softness, except for a case where a chain-stitch structure is knitted-in locally in a limited area of fastener tape with which a flange of a slider may touch. The present inventors have invented the present invention against such customary technical understanding.

A fastener stringer according to an aspect of the present disclosure may include: a knitted fastener tape; and a fastener element attached to the fastener tape, wherein the fastener tape includes a first side-edge portion where the fastener element is provided, a second side-edge portion provided at an opposite side of the first side-edge portion, and a tape main portion provided between the first and second side-edge portions, the first side-edge portion including one or more chain-stitch yarns formed in one or more wales, the second side-edge portion not including a chain-stitch yarn, the tape main portion including M or more chain-stitch yarns formed in M or more wales, M indicating a natural number equal to or greater than one third of the total number of wales included in the fastener tape, and difference in yarn density being caused between the tape main portion and the second side-edge portion.

In some embodiments, M may indicate a natural number equal to or greater than one half of the total number of wales included in the fastener tape.

In some embodiments, every wale in the tape main portion includes a chain-stitch yarn.

In some embodiments, the number of type of knit structure included in the second side-edge portion may be less than the number of type of knit structure included in the first side-edge portion and the tape main portion.

In some embodiments, the first side-edge portion and the tape main portion may include a same type of knitting yarn.

In some embodiments, the first side-edge portion and the tape main portion may include one or more tricot yarns.

In some embodiments, the first side-edge portion, the tape main portion and the second side-edge portion may include one or more satin yarns.

In some embodiments, the second side-edge portion may include: a wale in which loops of a tricot yarn are arranged in every other course along a wale direction; and loops of the satin yarn formed at a remote position from the tape main portion than said wale.

In some embodiments, the first side-edge portion, the tape main portion and the second side-edge portion may include one or more insertion yarns that swings in a swing width across plural wales.

In some embodiments, the color of at least one yarn included in the tape main portion may differ from the color of other yarns included in the second side-edge portion and the tape main portion.

In some embodiments, the color of at least one yarn at least partially included in a wale adjacent to a boundary between the second side-edge portion and the tape main portion may differ from the color of other yarns included in the second side-edge portion and the tape main portion.

In some embodiments, a pattern may be arranged in the tape main portion by selective removal of yarn.

A slide fastener according to an aspect of the present disclosure may include: a pair of fastener stringers; a slider for opening and closing the pair of fastener stringers, wherein each fastener stringer is a fastener stringer according to any one of claims 1-11, and the slider comprises a base plate, a post provided on the base plate, left and right walls respectively provided on left-side and right-side edge portions of the base plate, and left and right top plates extending toward the post from the respective top portions of the left and right walls.

An aspect of the present disclosure may cause a difference in yarn density between a tape main portion with chain-stitch structure and a second side-edge portion without chain-stitch structure, thus obtaining an indication of improvement of stretch properties or softness of a fastener tape.

BRIEF DESCRIPTION OF DRAWINGS

Embodiments and features of the present disclosure will be described with reference to the attached drawings in which same elements are identified by same reference number.

FIG. 1 is a schematic elevational view of a slide fastener according to an aspect of the present disclosure.

FIG. 2 is a view illustrating a schematic cross-sectional configuration of a slide fastener in which a slider of a slide fastener is schematically shown by a dash-dot line.

FIG. 3 is a schematic top view of a slider.

FIG. 4 is a schematic diagram showing a knit structure of a fastener tape according to an aspect of the present disclosure, in which water-soluble chain-stitch yarn and water-soluble tricot yarn are knitted into a second side-edge portion.

FIG. 5 is a schematic diagram showing a knit structure of a fastener tape after the water-soluble yarns are removed, in which loop of satin yarn and vacant space (where no knitting yarn exists) are alternately arranged along a wale direction at a wale in a second side-edge portion positioned farthest from a tape main portion.

FIG. 6 is a schematic diagram showing a knit structure of a fastener tape after three water-soluble chain-stitch yarns at three wales included in a second side-edge portion are removed, loop of satin yarn and loop of tricot yarn being arranged alternately along a wale direction at a wale in a second side-edge portion positioned farthest from a tape main portion.

FIG. 7 is a reference diagram showing types of knit structures included in a fastener tape.

FIG. 8 is a schematic illustration showing an arrangement of knitting yarns in a second side-edge portion and an adjacent portion of a tape main portion of a fastener tape shown in FIG. 5.

FIG. 9 is a schematic illustration showing an arrangement of knitting yarns in a second side-edge portion and an adjacent portion of tape main portion of a fastener tape shown in FIG. 6.

FIG. 10 is a diagram showing an embodiment where the color of chain-stitch yarn in a tape main portion differs from the color of other yarns in a second side-edge portion and a tape main portion.

FIG. 11 is a diagram showing an embodiment where the color of tricot yarn forming loops at two wales sandwiching a boundary between a second side-edge portion and a tape main portion differs from the color of other yarns in the second side-edge portion and the tape main portion.

FIG. 12 is a diagram showing an embodiment where the color of tricot yarn in a second side-edge portion differs from the color of other yarns in a second side-edge portion and a tape main portion.

FIG. 13 is a diagram showing an embodiment where the color of tricot yarn in a tape main portion differs from the color of other yarns in a second side-edge portion and a tape main portion.

FIG. 14 is a diagram showing an embodiment where a satin yarn in a tape main portion is selectively removed.

DETAILED DESCRIPTION

Hereinafter, various non-limiting embodiments will be described with reference to FIGS. 1 to 14. A given feature described for one embodiment will be construed to be effective not only for that embodiment but also for other various embodiments not disclosed or described in this application. Therefore, the extracted feature from a given embodiment will be construed as not necessarily requiring combination with other features extracted from that embodiment. Referenced drawings are prepared for the purpose of illustration of invention, and may possibly be simplified for the sake of convenience of illustration.

As shown in FIG. 1, a slide fastener 9 has a pair of left and right fastener stringers 7, and a slider 8 for opening and closing the pair of left and right fastener stringers 7. Each fastener stringer 7 has a fastener tape 5, and a fastener element 6 attached to the fastener tape 5. Frontward movement of slider 8 closes the left and right fastener stringers 7 and engages the left and right fastener elements 6. Rearward movement of slider 8 opens the left and right fastener stringers 7 and disengages the left and right fastener elements 6. In this specification, front-rear direction will be construed based on a moving direction of slider 8. Left-right direction will be construed based on left and right fastener stringers 7 or left and right fastener elements 6 which are to be opened and closed by the slider 8. Up-down direction is a direction orthogonal to the front-rear and left-right directions.

As shown in FIGS. 1 and 2, the fastener tape 5 includes a first side-edge portion 51 where the fastener element 6 is provided, a second side-edge portion 52 provided at an opposite side of the first side-edge portion 51 in the width direction and/or course direction of the fastener tape 5, and a tape main portion 53 provided between the first and second side-edge portions 51, 52 in the width direction and/or course direction of the fastener tape 5. As will be discussed below, the fastener tape 5 includes a knit structure, more particularly a warp knit structure, thus suppressing excessive expansion and contraction along a wale direction. Note that, the wale direction of a fastener tape 5 is same as the front-rear direction in the slide fastener 9, basically. Course direction of a fastener tape 5 is same as the left-right direction in the slide fastener 9.

The fastener element 6 may be a coil element and may be sewn to the first side-edge portion 51 by sewing-thread(s). Embodiment is envisioned where the coil element is weaved into a knit structure of the fastener tape 5 together when the fastener tape 5 is knitted. Needless to say, embodiments are envisioned where the fastener element 6 includes resin or metal elements.

The slide fastener 9 is a conceal-type slide fastener, not necessarily limited to this though. The first side-edge portion 51 of the fastener tape 5 is bent downward of the tape main portion 53 and arranged under the tape main portion 53. Spacing between the first side-edge portion 51 and the tape main portion 53 serves as a passage for a top plate 84 of a slider 8 which is described hereinafter.

The tape main portion 53 has a top surface 53*a* and a bottom surface 53*b*, and the first side-edge portion 51 has a top surface 51*a* and a bottom surface 51*b*. Due to the turn of the first side-edge portion 51, the top surface 51*a* of the first side-edge portion 51 and the bottom surface 53*b* of the tape main portion 53 have a continuity. In other words, the top surface 51*a* of the first side-edge portion 51 and the bottom surface 53*b* of the tape main portion 53 are included in a bottom surface of the fastener tape 5. Due to the turn of the first side-edge portion 51, the bottom surface 51*b* of the first side-edge portion 51 and the top surface 53*a* of the tape main portion 53 have a continuity. The fastener element 6 is sewn to the bottom surface 51*b* of the first side-edge portion 51. Engagement heads 61 of the fastener element 6 are arranged to project in the left-right direction relative to the turning portion 59 of the fastener tape 5 to which that fastener element 6 is attached. When the left and right fastener stringers 7 are closed, the respective turning portions 59 of the fastener tapes 5 are not necessarily in contact one another as schematically shown in FIG. 2.

The slider 8 may be made of resin or metal or ceramics, but should not be limited thereto. As shown in FIGS. 2 and 3, the slider 8 includes a base plate 81, a post 82 provided on the base plate 81, left and right walls 83 respectively provided on left and right side-edges of the base plate 81, and left and right top plates 84 extend to the post 82 from the respective top portions of the left and right walls 83. The post 82 is arranged at a center of the base plate 81 in the left-right direction. Paired left and right front mouths 86 are arranged at the left and right sides of the post 82. A rear mouth 87 is arranged at the opposite side of the front mouths 86 in the front-rear direction. Y-shaped element passage is configured by the post 82 and the left and right walls 83. Left and right fastener elements 6 having entered into the slider 8 via the left and right front mouths 86 are engaged one another after passing by the post 82. Engaged left and right fastener elements 6 having entered into the slider 8 via the rear mouth 87 are disengaged one another when passing by the post 82.

It would be appreciated, when the slider 8 is viewed from an upper side, the post 82 and the left and right top plates 84 of the slider 8 configure a Y-shaped tape passage for the left and right fastener tapes 5. As shown in FIGS. 4 and 5, in some embodiments, a chain-stitch structure is knitted into a portion (i.e. a turning portion 59) of the tape main portion 53 positioned adjacent to the first side-edge portion 51 of the fastener tape 5. The tape main portion 53 is suppressed from being worn due to physical contact or friction between the turning portion 59 of the tape main portion 53 and the top plate 84 of the slider 8. Note that the top portion of the post 82 of the slider 8 may be provided with a pull-tab attachment portion 85.

Envisioned is that a fastener tape 5 is sewn to a fabric along a curved line. In this case, a broken line L1 (See FIG. 1) showing a sewing position of a fastener tape 5 to the fabric is curved, resulting in that the second side-edge portion 52 extending in parallel with the broken line L1 is curved. If the second side-edge portion 52 has insufficient stretch properties, it is likely that wrinkles are formed in the fastener tape 5 or in the fabric. Therefore, appropriate stretch properties or softness may desirably be given to the fastener tape 5 in order to be used in such an application. In contrast, there is a desire to distinguish fastener tapes with enhanced stretch properties or softness from fastener tapes without such enhanced stretch properties or softness. If a fastener tape without enhanced stretch properties or softness is confused with a fastener tape with enhanced stretch properties or softness, the above-described wrinkles may be formed, and an appearance of products such as a women dress to which the slide fastener 9 is sewn may possibly be deteriorated. Note that an exemplary fastener tape without enhanced stretch properties or softness (e.g. having substantially no stretch properties or low softness) may include a chain-stitch structure in the second side-edge portion 52.

In the present embodiment, as would be appreciated from the following descriptions, the first side-edge portion 51 includes one or more chain-stitch yarns formed in one or more wales; the second side-edge portion 52 includes no chain-stitch yarn; and the tape main portion 53 includes one or more chain-stitch yarns formed in M or more wales. Here, M indicates a natural number equal to or greater than one third of the total number of wales included in the fastener tape 5. Furthermore, there is a difference in yarn density between the tape main portion 53 and the second side-edge portion 52. Difference in yarn density is caused between the tape main portion 53 with a chain-stitch structure and a second side-edge portion 52 without a chain-stitch structure, presenting an indication of improvement of stretch properties or softness of the fastener tape 5. This facilitates distinguishableness of fastener tapes 5 with enhanced stretch properties or softness from fastener tapes without such improvement. In some embodiments, there is a difference in yarn density between the tape main portion 53 and the second side-edge portion 52 which is perceivable by human eyes. Also, in some embodiments, M indicates a natural number equal to or greater than one half of the total number of wales included in the fastener tape 5.

FIG. 4 is a schematic diagram showing a knit structure of the fastener tape 5, in which water-soluble chain-stitch yarn and water-soluble tricot yarn are knitted into the second side-edge portion 52. Note that a water-soluble yarn may be a yarn other than the tricot yarn. FIG. 5 is a schematic diagram showing a knit structure of a fastener tape after the water-soluble yarns are removed. As shown in FIG. 4, the fastener tape 5 is configured from a warp knit structure. The warp knit structure may include a chain-stitch structure, a tricot structure, and a satin structure. In other words, chain-stitch yarns, tricot yarns and satin yarns are knitted so that the warp knit structure is formed.

The fastener tape 5 has total 13 wales W1-W13. The first side-edge portion 51 includes the wales W1, W2 and W3. The second side-edge portion 52 includes the wales W12 and W13. The tape main portion 53 includes the wales W4, W5, W6, W7, W8, W9, W10 and W11. Note that the number of wales in each of the first side-edge portion 51, the second side-edge portion 52 and the tape main portion 53 should not be limited to these numbers. Each of the first side-edge portion 51, the second side-edge portion 52, and the tape main portion 53 includes a chain-stitch structure (chain-stitch yarns), tricot structure (tricot yarns) and satin structure (satin yarns). Note that, as would be appreciated by comparing FIGS. 4 and 5, the chain-stitch yarn and the tricot yarn in the second side-edge portion 52 are removed after the fastener tape 5 is knitted. Therefore, the number of type of knit structure included in the second side-edge portion 52 will be lesser than the number of type of knit structure included in the first side-edge portion 51 and the tape main portion 53.

As shown in FIG. 7, a chain-stitch yarn 55 is knitted to form loops in respective courses along one wale so that a chain-stitch structure is formed. The chain-stitch structure may be formed by one or more, or a plurality of chain-stitch yarns. Tricot yarn 56 is knitted in a wale direction while forming loops alternately in adjacent wales so that a tricot structure is formed. The tricot structure may be formed by one or more, or a plurality of tricot yarns. Satin yarn 57 is knitted in a wale direction while forming loops alternately in separated wales by which a plurality of wales is sandwiched, so that a satin structure is formed. The satin structure maybe formed from one or more, or a plurality of satin yarns.

Additionally or alternatively to the satin yarn 57, insertion yarn 58 which does not form loops may be used. The insertion yarn 58 may swing in a given swing width across a plurality of wales without forming loops and may be inserted into another or other knit structures (e.g. tricot structure and/or chain structure).

Two chain-stitch yarns included in the second side-edge portion 52 of the fastener tape 5 shown in FIG. 4 are removed after the fastener tape 5 is knitted. It is envisioned that, as one approach, water-soluble chain-stitch yarns is employed. For example, the fastener tape 5 shown in FIG. 4 is immersed in a dyeing solution at a step of dyeing after the fastener tape 5 is knitted. At this instance, the water-soluble chain-stitch yarns in the second side-edge portion 52 of the fastener tape 5 are dissolved into the solution of the dyeing solution. Note that various other ex-post measures can be employed for removing the chain-stitch yarns.

One tricot yarn included in the second side-edge portion 52 of the fastener tape 5 shown in FIG. 4 is removed after the fastener tape 5 is knitted. It is envisioned that, as one approach, water-soluble tricot yarn is employed. The fastener tape 5 shown in FIG. 4 is immersed into the dyeing solution at a step of dyeing after the fastener tape 5 is knitted. At this instance, the water-soluble tricot yarn in the second side-edge portion 52 of the fastener tape 5 is dissolved into the solution of the dyeing solution. Note that various other ex-post measures can be employed for removing the tricot yarn. Other yarns in the fastener tape 5 shown in FIG. 4 are non-water-soluble yarns. Both none-water-soluble and water-soluble yarns are available in a market.

After water-soluble two chain-stitch yarns and one tricot yarn are removed in the second side-edge portion 52 of the fastener tape 5 shown in FIG. 4, a fastener tape 5 shown in FIG. 5 is obtained. Loop of the satin yarn and vacant space (where no knitting yarn exists) are alternately arranged along the wale direction at the wale W13 in the second side-edge portion 52 positioned farthest from the tape main portion 53. The loop of the satin yarn arranged at the wale W12, W13 in the second side-edge portion 52 is one of a pair of loops formed alternately in separated wales that sandwich a plurality of wales, and the other loop is arranged in the tape main portion 53. In different/adjacent wales W12 and W13 in the second side-edge portion 52, the loop of the satin yarn (at the wale W13) and the loop of the tricot yarn (at the wale W12) are arranged alternately along the wale direction. The loop of the tricot yarn formed at the wale W12 in the second side-edge portion 52 is one of a pair of loops formed alternately in adjacent wales, and the other loop is arranged in the tape main portion 53. In the wale W12 sitting next to the wale W13 in the second side-edge portion 52 positioned farthest from the tape main portion 53, the loops of the tricot yarn and the loops of the satin yarn are arranged alternately along the wale direction. Loops of satin yarn are formed at a remote position farther away from the tape main portion 53 than the wale W12 where the loops of tricot yarn are arranged in every two courses along the wale direction. Furthermore, the loops of satin yarn are arranged in every two courses in the courses where the loop of tricot yarn in the wale W12 is not arranged. The second side-edge portion 52 is not necessarily configured from two wales W12 and W13 as shown in FIG. 5, and an embodiment is envisaged where the second side-edge portion 52 includes additional wales.

The tape main portion 53 of the fastener tape 5 shown in FIG. 5 may include one or more chain-stitch yarns formed in the 8 wales, in particular may include 8 chain-stitch yarns formed in the 8 wales. The total number of wales included in the fastener tape 5 is 13. In contrast, the number of wales included in the tape main portion 53 is 8. 8>(13/3) is satisfied. Furthermore, 8>(13/2) is satisfied. In one hand, the tape main portion 53 includes a chain-stitch structure and has a higher yarn-density. In the other hand, the second side-edge portion 52 does not include a chain-stitch yarn and has a lower yarn-density. It is possible for human eyes to see a difference in yarn density between the second side-edge portion 52 and the tape main portion 53, thus presenting an indication of improvement of stretch properties or softness of a fastener tape.

As stated in the beginning, if a chain-stitch yarn is introduced into a fastener tape 5, in particular into a tape main portion 53, stretch properties or softness of the fastener tape 5 will be lowered. In the present invention, against such a prior technical understanding, a chain-stitch yarn is introduced into the tape main portion 53 of the fastener tape 5, and it is newly identified that an indication of a type of fastener tape 5 can be obtained based on a difference in yarn density between the second side-edge portion 52 and the tape main portion 53. As there is no chain-stitch yarn in the second side-edge portion 52, required and sufficient stretch properties or softness of the fastener tape 5 can be obtained. Therefore, even in a case where a fastener tape 5 is sewn to a fabric along a curved line, wrinkles are suppressed to be formed on the fastener tape 5 or on the fabric.

If the stretch properties or softness of fastener tape 5 was too great/high, the left and right fastener elements 6 may possibly be not engaged suitably when the left and right fastener stringers 7 are to be closed. If the fastener tape 5 was extremely soft, a strength against a laterally pulling force of closed left and right fastener stringers 7 may possibly be lowered. In the present embodiment, the hardness of the tape main portion 53 and the softness of the second side-edge portion 52 are well balanced, facilitating that not only wrinkles are suppressed but also smooth engagement of fastener elements 6 and sufficient strength against a laterally pulling force are ensured.

FIG. 6 shows a fastener tape 5 where water-soluble chain-stitch yarns knitted in the wales W11-W13 are removed, unlike FIG. 5. As shown in FIG. 6, the second side-edge portion 52 includes 3 wales W11-W13. In the wale W13 positioned farthest from the tape main portion 53 in the second side-edge portion 52, the loop of satin yarn and the loop of tricot yarn are arranged alternately along the wale direction. In this case either, the loop of the satin yarn arranged at the wale W11, W12 or W13 in the second side-edge portion 52 is one of a pair of loops formed alternately in separated wales that sandwich a plurality of wales, and the other loop is arranged in the tape main portion 53. Also, the loop of the tricot yarn formed at the wale W12 or W13 in the second side-edge portion 52 is one of a pair of loops formed alternately in adjacent wales, and the other loop is arranged in the second side-edge portion 52. The other loop associated with the loop of the tricot yarn at the wale W11 is arranged in the tape main portion 53. Similar technical effect as described above can be obtained even in such an embodiment.

FIG. 8 is a schematic illustration showing an arrangement of knitting yarns in the second side-edge portion 52 and an adjacent portion of the tape main portion 53 of the fastener tape 5 shown in FIG. 5. FIG. 9 is a schematic illustration showing an arrangement of knitting yarns in the second side-edge portion 52 and an adjacent portion of the tape main portion 53 of the fastener tape 5 shown in FIG. 6. There is a difference between a yarn density of the second side-edge portion 52 and a yarn density of the tape main portion 53 of the fastener tape 5 shown in FIG. 8. In particular, the yarn density in the second side-edge portion 52 of the fastener tape 5 is less than the yarn density in the tape main portion 53. The yarn density in the second side-edge portion 52 becomes smaller as the tricot yarn is removed additionally to the chain-stitch yarns in the second side-edge portion 52 of the fastener tape 5. As a result, a difference in yarn density between the second side-edge portion 52 and the tape main portion 53 will be greater.

Yarn density may be expressed by a ratio of total volume of yarns per unit space or may be expressed by the number or weight of yarns per unit area in the top or bottom surface of the fastener tape 5. Additionally or alternatively, yarn density can be expressed by a light transmission ratio per unit area in the top or bottom surface of the fastener tape 5. Yarn density and light transmission ratio are correlated, and the light transmission ration increases as yarn density decreases. Therefore, it would be possible to determine yarn density based on a light transmission ratio.

In a case where the second side-edge portion 52 of the fastener tape 5 shown in FIG. 8 is sewn to a fabric, if a sewing thread is needled outward of the wale W12 and through a spacing between loops of satin yarn in the wale W13, the second side-edge portion 52 of the fastener tape 5 cannot be sewn to the fabric. This is because tricot yarn forming loops alternately in the wales W12 and W13 have been removed as described above. However, the second side-edge portion 52 includes a wale W12 where loop of satin yarn and loop of tricot yarn are arranged alternately along the wale direction which allows the wale W12 to function as a retainer when sewing is performed in a position inward of the wale W12.

Likewise FIG. 8, there is a difference between yarn densities of the tape main portion 53 and the second side-edge portion 52 of the fastener tape 5 shown in FIG. 9. In particular, the yarn density of the second side-edge portion 52 is less than the yarn density of the tape main portion 53 in the fastener tape 5. Compared with the fastener tape 5 of FIG. 8, the fastener tape 5 of FIG. 9 has greater yarn density in the second side-edge portion 52 as tricot yarn is not removed additionally to the chain-stitch yarn of the second edge portion 52. However, the yarn density of this second side-edge portion 52 is still less than the yarn density of the tape main portion 53 where the chain-stitch structure is introduced.

In a case where the second side-edge portion 52 of the fastener tape 5 shown in FIG. 9 is sewn to a fabric, the second side-edge portion 52 of the fastener tape 5 can be sewn to the fabric even when a sewing thread is needled outward of the wale W12 and through the wale W13. This is because the tricot yarn forming loops alternately in the wales W12 and W13 is not removed unlike FIG. 8. In this case, both wales W12 and W13 serve as a retainer. Note that, embodiment is envisioned where the second side-edge portion 52 is not sewn to a fabric, e.g. inner side of the fabric.

As would be understood from the above descriptions, in the present embodiment, the first side-edge portion 51 includes one or more chain-stitch yarns formed in one or more wales; the second side-edge portion 52 does not include a chain-stitch yarn; and the tape main portion 53 includes one or more chain-stitch yarns formed in M or more wales. Here, M indicates a natural number equal to or greater than one third of the total number of wales included in the fastener tape 5. Furthermore, there is a difference in yarn density between the tape main portion 53 and the second side-edge portion 52. Difference in yarn density is caused between the tape main portion 53 with a chain-stitch structure and a second side-edge portion 52 without a chain-stitch structure, thus presenting an indication of improvement of stretch properties or softness of the fastener tape 5. This facilitates distinguishableness of a fastener tape 5 with enhanced stretch properties or softness from a fastener tape without such improvement.

Furthermore, the fastener tape 5 according to the present disclosure allows to avoid a necessary reconfiguration of an existing knitting machine or to reduce an extent of such reconfiguration. In the fastener tape having a knit structure shown in FIG. 4, chain-stitch yarns are knitted in all wales W1-W13 (Water-soluble chain-stitch yarns are knitted in the wales W12 and W13). When a knitting machine is to be reconfigured to its original condition after the knitting machine was reconfigured so as not to knit chain-stitch yarns in several wales, non-negligible burden may be required such as operational burden of passing yarn(s) through complicated mechanism(s) in the knitting machine. In the fastener tape 5 according to the present disclosure, chain-stitch yarns are knitted in all wales W1-W13, avoiding such necessary reconfiguration of the knitting machine. Note that, the cost will be increased out of acceptable range if water-soluble yarns were used for the chain-stitch yarns in the tape main portion 53 similar to the chain-stitch yarns in the second side-edge portion 52.

In some embodiments, as shown in FIG. 10, the color of at least one yarn included in the tape main portion 53 differs from the color of other yarns included in the second side-edge portion 52 and the tape main portion 53. The color of one of more yarns in the tape main portion 53 having greater yarn density than the second side-edge portion 52 is selectively changed compared with the color of other yarns in the second side-edge portion 52 and the tape main portion 53. Additional indication of the improvement of stretch properties or softness of the second side-edge portion 52 and/or indication of sewing position of the fastener tape 5 relative to a fabric will be obtained.

The tape main portion 53 includes plural chain-stitch yarns, plural tricot yarns, and plural satin yarns. The color of one or more yarns selected from the chain-stitch yarn, the tricot yarn and the satin yarn may be changed. Envisioned are embodiment where the color of two or more yarns is changed for both chain-stitch yarn and the tricot yarn, embodiment where the color of two or more yarns is changed for both tricot yarn and satin yarn, embodiment where the color of two or more yarns is changed for both chain-stitch yarn and the satin yarn, and embodiment where the color of three or more yarns is changed for all of the chain-stitch yarn, the tricot yarn and the satin yarn.

In FIG. 10, the color of chain-stitch yarn at wale W10 in the tape main portion 53 adjacent to the second side-edge portion 52 differs from the color of other knitting yarn in the second side-edge portion 52 and the tape main portion 53. For example, the color of chain-stitch yarn at wale W10 is yellow, and the color of chain-stitch yarn at other wales W4-W9 is black. The color of every tricot yarn and satin yarn included in the fastener tape 5 is black. It may be possible to easily identify visually the yellow chain-stitch yarn in the tape main portion 53 having a ground color of black and having greater yarn density due to the existence of the chain-stitch yarns. The yellow color chain-stitch yarn at the wale W10 may serve as an indication of improvement of stretch properties or softness of a second side-edge portion 52 and/or an indication of sewing position of a fastener tape 5 relative to a fabric. The ground color of the fastener tape 5 may typically be black, but may be other colors such as red or blue for example.

Embodiment is envisioned where the color of tricot yarn nearby a boundary between the second side-edge portion 52 and the tape main portion 53 is selectively changed as an alternative to selectively changing the color of a chain-stitch yarn. The color of tricot yarn knitted in the wale direction while forming loops alternately at the wales W10 and W11 or wales W9 and W10 is different from the color of other knitting yarns in the second side-edge portion 52 and/or the tape main portion 53.

In the case shown in FIG. 10, the color of at least one yarn (highlighted by bold line in FIG. 10) at least partially included in the wale W10 adjacent to a boundary between the second side-edge portion 52 and the tape main portion 53 differs from the color of other yarns included in the second side-edge portion 52 and the tape main portion 53. In particular, the color of chain-stitch yarn at wale W10 in FIG. 10 is selectively changed. The chain-stitch yarn at wale W10 in FIG. 10 may be an indication of a boundary between the second side-edge portion 52 and the tape main portion 53 or an indication of appropriate sewing position. As an example, as described above, the ground color of the fastener tape 5 is black, and the color of the chain-stitch yarn at wale W10 is yellow. Note that, the boundary between the second side-edge portion 52 and the tape main portion 53 lies between the wales W10 and W11.

In a case shown in FIG. 11, the color of at least one yarn (highlighted by bold line in FIG. 11) at least partially included in the wales W10 and W11 adjacent to a boundary between the second side-edge portion 52 and the tape main portion 53 differs from the color of other yarns included in the second side-edge portion 52 and the tape main portion 53. The color of tricot yarn knitted in the wale direction while forming alternately loops at wales W10 and W11 in FIG. 11 is selectively changed. Tricot yarn at wales W10, W11 in FIG. 11 serves as an indication of a boundary between the second side-edge portion 52 and the tape main portion 53, i.e. an appropriate sewing position. As an example, as described above, the ground color of the fastener tape 5 is black, and the color of the tricot yarn at wales W10, W11 is yellow.

In a case shown in FIG. 12, likewise FIG. 11, the color of at least one yarn (tricot yarn highlighted by bold line) at least partially included in the wale W11 adjacent to a boundary between the second side-edge portion 52 and the tape main portion 53 differs from the color of other yarns included in the second side-edge portion 52 and the tape main portion 53. The tricot yarn of the bold line is knitted in the wale direction so as to form loops alternately in the wales W11 and W12.

In a case shown in FIG. 13, likewise FIGS. 11 and 12, the color of at least one yarn (tricot yarn highlighted by bold line) at least partially included in the wale W10 adjacent to a boundary between the second side-edge portion 52 and the tape main portion 53 differs from the color of other yarns included in the second side-edge portion 52 and the tape main portion 53. The tricot yarn of bold line is knitted in the wale direction so as to form loops alternately in the wales W9 and W10. Various combinations of examples shown in FIGS. 10-13 are envisioned. Embodiment is envisioned where the color of satin yarn or insertion yarn is changed alternatively to chain-stitch yarn and tricot yarn.

Embodiment is envisioned where the color of satin yarn or insertion yarn is selectively changed which is knitted so as to cross a boundary between the second side-edge portion 52 and the tape main portion 53. As an example, the color of satin yarn knitted in the wale direction while forming loops alternately in the wales W9 and W12 differs from the color of other knitting yarns in the second side-edge portion 52 and/or the tape main portion 53. Note that, as a method for changing the color of knitting yarn, available are not only pre-dyed yarns with different color, but also available are use of yarns of different material relative to other yarns (e.g. use of a yarn made of nylon and a yarn made of polyester) and use of a differently processed yarn so as to change a manner the yarn is dyed during a process of dyeing even when a same material is used for the yarns.

FIG. 14 shows an embodiment where a satin yarn in the tape main portion 13 is selectively removed. In FIG. 14, the selectively removed satin yarn is illustrated by a dotted line. As shown in FIG. 14, in some embodiments, a pattern is arranged in the tape main portion 53 by selective removal of the yarn. Additional indication of improvement of stretch properties or softness of the second side-edge portion 52 and/or indication of sewing position of the fastener tape 5 to a fabric would be obtained. Embodiment is envisioned where water-soluble yarn is used for the satin yarn to be removed, likewise the removal of the chain-stitch yarn in the second side-edge portion 52. Yarn to be removed in the tape main portion 53 should not be limited to a satin yarn but could be a chain-stitch yarn or tricot yarn. Any combination of chain-stitch yarn, tricot yarn and satin yarn can be removed.

Based on the above teaching, a skilled person in the art would be able to add various modifications to the respective embodiments. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made. Reference numerals in Claims are just for reference and should not be referred for the purpose of narrowly construing the scope of claims.

What is claimed is:

1. A fastener stringer comprising:

a knitted fastener tape; and a fastener element attached to the fastener tape, wherein the fastener tape includes a first side-edge portion where the fastener element is provided, a second side-edge portion provided at an opposite side of the first side-edge portion, and a tape main portion provided between the first and second side-edge portions, the first side-edge portion including one or more chain-stitch yarns formed in one or more wales, the second side-edge portion not including a chain-stitch yarn, the tape main portion including M or more chain-stitch yarns formed in M or more wales, M indicating a natural number equal to or greater than one third of the total number of wales included in the fastener tape, and difference in yarn density being caused between the tape main portion and the second side-edge portion.

2. The fastener stringer of claim 1, wherein M indicates a natural number equal to or greater than one half of the total number of wales included in the fastener tape.

3. The fastener stringer of claim 1, wherein every wale in the tape main portion includes a chain-stitch yarn.

4. The fastener stringer of claim 1, wherein the number of type of knit structure included in the second side-edge portion is less than the number of type of knit structure included in the first side-edge portion and the tape main portion.

5. The fastener stringer of claim 1, wherein the first side-edge portion and the tape main portion include a same type of knitting yarn.

6. The fastener stringer of claim 1, wherein the first side-edge portion and the tape main portion include one or more tricot yarns.

7. The fastener stringer of claim 1, wherein the first side-edge portion, the tape main portion and the second side-edge portion include one or more satin yarns.

8. The fastener stringer of claim 7, wherein the second side-edge portion comprises:

a wale in which loops of a tricot yarn are arranged in every other course along a wale direction; and loops of the satin yarn formed at a remote position from the tape main portion than said wale.

9. The fastener stringer of claim 1, wherein the first side-edge portion, the tape main portion and the second side-edge portion include one or more insertion yarns that swings in a swing width across plural wales.

10. The fastener stringer of claim 1, wherein the color of at least one yarn included in the tape main portion differs from the color of other yarns included in the second side-edge portion and the tape main portion.

11. The fastener stringer of claim 1, wherein the color of at least one yarn at least partially included in a wale adjacent to a boundary between the second side-edge portion and the tape main portion differs from the color of other yarns included in the second side-edge portion and the tape main portion.

12. The fastener stringer of claim 1, wherein a pattern is arranged in the tape main portion by selective removal of yarn.

13. A slide fastener comprising:

a pair of fastener stringers;

a slider for opening and closing the pair of fastener stringers, wherein each fastener stringer is a fastener stringer according to claim 1, and the slider comprises a base plate, a post provided on the base plate, left and right walls respectively provided on left-side and right-side side edge portions of the base plate, and left and right top plates extending toward the post from the respective top portions of the left and right walls.

* * * * *